US010435121B2

(12) United States Patent
Kumano

(10) Patent No.: US 10,435,121 B2
(45) **Date of Patent: *Oct. 8, 2019**

(54) SURFBOARD FIN ATTACHMENT STRUCTURE AND SURFBOARD

(71) Applicant: Michiaki Ishida, Dana Point, CA (US)

(72) Inventor: Katsuyoshi Kumano, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/646,050

(22) Filed: Jul. 10, 2017

(65) Prior Publication Data

US 2017/0305511 A1 Oct. 26, 2017

Related U.S. Application Data

(63) Continuation-in-part of application No. 14/379,151, filed on Apr. 7, 2015, now Pat. No. 9,701,371.

(51) Int. Cl.
*B63B 35/79* (2006.01)

(52) U.S. Cl.
CPC ..... *B63B 35/793* (2013.01)

(58) Field of Classification Search
CPC ..... B63B 1/00; B63B 35/79; B63B 35/793
USPC ..... 441/79
See application file for complete search history.

(56) References Cited

U.S. PATENT DOCUMENTS

| | | | | |
|---|---|---|---|---|
| 7,037,154 | B1 * | 5/2006 | Suzuki | B63B 35/793 441/74 |
| 9,701,371 | B2 * | 7/2017 | Kumano | B63B 35/793 |

FOREIGN PATENT DOCUMENTS

| | | |
|---|---|---|
| JP | H06-255575 | 9/1994 |
| JP | 2001-520961 | 11/2001 |
| JP | 2002-530242 | 9/2002 |
| JP | 2003-306195 | 10/2003 |
| JP | 2005-74026 | 3/2005 |
| JP | 2005-112206 | 4/2005 |
| JP | 2006-280839 | 10/2006 |

* cited by examiner

*Primary Examiner* — Lars A Olson
(74) *Attorney, Agent, or Firm* — Nienstadt PLLC

(57) ABSTRACT

A fin box is provided for detachably attaching a fin to a surfboard. The surfboard has a nose and a tail at opposite ends. The fin has a groove base with one or more pins. The fin box includes one or more inner walls. The inner walls have (i) a hollow base with a width that is at least as great as a width of the groove base and a length that is at least as great as a length of the groove base, (ii) one or more recess parts disposed at locations that correspond to the locations of the pins of the fin, the recess parts extending in a direction that is substantially perpendicular to a length of the fin box, and (iii) one or more ditch parts that extend from the recess parts, the ditch parts extending in a direction that is substantially parallel to the length of the fin box and toward the tail of the surfboard. The recess parts and ditch parts are configured to allow the fin to be inserted into the fin box by (i) pressing the fin downward into the fin box until a bottom of the groove base is adjacent to the hollow base, and (ii) sliding the fin toward the tail of the surfboard, without any opposite motion toward the nose of the surfboard. The ditch parts are configured to, when the fin is attached to the fin box, hold the pins of the fin in the fin box.

1 Claim, 7 Drawing Sheets

SURFBOARD FIN ATTACHMENT STRUCTURE AND SURFBOARD

CLAIM FOR PRIORITY

This application is a continuation-in-part of application Ser. No. 14/379,151, filed Apr. 7, 2015, which is a U.S. national phase of International Application No. PCT/JP2012/053852, filed Feb. 17, 2012, all of which are incorporated herein by reference in their entireties.

TECHNICAL FIELD

This application relates to a fin structure of surfboard and, more specifically, relates to an attachment structure with which a fin can be detached and attached to the surfboard, wherein the fin is easily and closely attached and detached. The object of the invention relates to the fin attachment structure, which enables a perfect fit to the surfboard.

BACKGROUND

Thus far, there have been roughly two types of fin attachment structure of surfboard: a fixed fin type and a detachable fin type. Compared to a fixed fin type, a detachable fin type is used more frequently. There are various attachment structures because it allows the attachment of a fin of an arbitrary shape according to a user's preference and the fin can be detached and carried.

That is, a fin box etc. is arranged in advance on the bottom surface of a surfboard by embedding it, and then the fin is detachably mounted in the fin box. In this case, structures that allow a fin to be detachable and incorporate so-called screw fixing include those disclosed in Japanese Publication of Patent Application (Kokai) No. H6-255575 (patent document 1), Translated Japanese Publication of Patent Application No. 2001-520961 (patent document 2), Translated Japanese Publication of Patent Application No. 2002-530242 (patent document 3), and Japanese Unexamined Patent Publication (Kokai) No. 2003-306195 (patent document 4).

These have a structure m which screws, bolts, etc., are used to fasten a fan to the fin box. In addition, the structure bas 6rrooves in the fin box by which the fin is fastened into the fin box according to those disclosed in Japanese Unexamined Patent Publication (Kokai) No. 2005-74026 (patent document 5), Japanese Unexamined Patent Publication (Kokai) No. 2005-112206 (patent document 6), and Japanese Unexamined Patent Publication (Kokai) No. 2006-280839 (patent document 7).

Further, the structure in which the fin is fastened using a C-shaped clamp is disclosed in Translated Japanese Publication of Patent Application No. 2003-528003 (patent document 8). In addition to the above, structures in which the fin is fastened so that it can be attached in an easily detachable manner using a special locking member include those disclosed in Translated Japanese Publication of Patent Application No. 2005-508798 (patent document 9) and Translated Japanese Publication of Patent Application No. 2005-526664 (patent document 9). Furthermore, the structure in which both the fin box and the fin fitted therein has a fitting structure in a special shape so that the fin can be fastened in an easily detached manner is one disclosed in Japanese Unexamined Patent Publication (Kokai) No. 2007-16969 (patent document 11).

SUMMARY

As described above, there exist various attachment structures as to surfboard fins.

The structure disclosed in patent document 1 uses so-called screw fixing, in which a fin is attached by screwing or detached by unscrewing its screws. Because of this, attachment and detachment of fin requires a special tool, such as a screwdriver.

Next, in the structures disclosed in patent document 2, patent document 3, and patent document 4, a fin is screwed up in the transverse direction and detachment of the fin similarly requires a special tool such as a screwdriver. Thus a fin cannot easily be detached. Especially a fin cannot easily be attached and detached, on such locations as seaside, etc.

Further, the structures shown in patent document 5 and patent document 6 are those in which a fin is inserted along a groove and fastened to a predetermined position. The fin can be tightly attached, but also, can be attached/detached easily. However, structures described in patent document 5, fixing with a pin and projection and groove in patent document 6 allow a gap, not only a gap between an easy attaching fin and a fin box, but also gap between a pin and a groove, wherein the gap creates rattling.

It becomes especially difficult to detach a fin when a gap is filled. That is to say the tighter the attachment is, the greater becomes resistance which causes extreme difficulty at the time of detachment. Next, as to patent document 7, the fin is similarly inserted into the groove and moved along the groove to be attached. In this case, it is necessary to attach/detach the fin in accordance with the insertion procedure, and in particular, also in the attached state, in the rear end of the rotating groove. Unfortunately, after inserting, there is not sufficient force to hold it securely in place.

Next, in the configuration shown in patent document 8, the C-shaped damp is used to fasten the fin to the fin box, and the fin is tightly fitted into the damp to be attached in the fin box. In such a situation, a large force is required to detach the fin and at the same time, it is difficult to detach the fin unless the fin is pulled out in exact alignment with the fin box. Further, when a fin is attached to C-shaped clamp, there will inevitably be a space between the fin and the groove of the board. Such a space causes rattling.

According to patent document 9, a cam is rotated by the worm gears and thus the fin is fixed. Therefore, the rotation of the worm gears is necessary to attach/detach the fin, and it is extremely complicated procedure. According to patent document 10 also, a tag pin is put in the pin slot and tightened by the club screw, and in this way the fin is fastened tightly. However, it is a complicated procedure and at the same time, it is difficult to attach/detach the fin.

Further, as to patent document H, the fin can be attached easily, however its attaching is done by inserting the fin in the obliquely backward direction, and thus this procedure requires screw. Although the fin is able to be tightly attached, such a structure does not allow for easy attachment/detachment.

Additionally, the more easily a fin is attached/detached to the surfboard, the simpler the installation becomes. However, the result is a fin not tightly fixed to the surfboard. As described above, a certain fin attachment structure is desired, which enables a fin to be easily attached/detached and at the same time fastened tightly to the surfboard.

Especially, easily attached/detached fin rattles when connected. to the fin box, because there is inevitably a space, when the surfboard is in operation. This fin rattle may further result in the reduction of operability of a surfboard due to rattling and moving. Therefore, solutions to this problem may be required. Further, such a situation leads to such possibilities that a fin unexpectedly comes off and/or a fin may be damaged and/or broken. Thus, it has been required to solve such problems.

Embodiments described herein have been devised to solve all such problems. One embodiment has a fin attachment mechanism for detaching and attaching a fin to a surfboard by inserting a groove base which is mounted on a fin to a bottom surface of a hollow part of a fin box. The hollow part of a fin box is as wide as and/or wider than a fin attachment base portion. The hollow part of a fin box is longer than a fin attachment base portion. The hollow part of a fin box is deeper than a fin attachment base portion. On both side surfaces of the hollow part of a fin box there is a recess part where the pin is inserted. The insertion follows the length of the groove part with a set depth along the length of the fin box, extending in that direction all the way to the back of the board. The fin attachment base part has a pin on both sides, and each pin is corresponding to a recess part of the pin on both sides. At the time of inserting the fin attachment base part into the hollow part of a fin box, both the pin of the fin and recess part of the fin box are combined and inserted. After inserting the fin, the fin is moved backward. Thus, the fin attachment structures may enable easy attachment/detachment to the surfboard. Thus, the said problems can be solved.

In another embodiment, the fin attachment structure may be one having at least two plungers provided at the opposing positions on both side surfaces of the groove part on the side surface of the groove part along the lengthwise direction, Further, in another embodiment, the structure may be one having a hollow part at the opposing positions on both side surfaces of the groove part, wherein the plunger is mounted in the hollow part.

In the above cases, in another embodiment, the structure may be one having at least two base portions which cope with the hollow parts on both side surfaces of the groove part along the lengthwise direction. Thus, a fin may be attached by inserting the base portion into the applicable hollow part.

In addition to these, in another embodiment, the pin on both the end portions located in the corner portion of the attachment base portion of the fin to be inserted into the groove part in the nose direction may be configured by the inclined side part. Further, in another embodiment, a surfboard, which applies the fin attachment structure described above, may resolve the aforementioned issues.

As aforementioned, in one embodiment, at the time of a fin attachment, a fin can be fixed between the pins, which are mounted on both side surfaces of the groove bases, and the ditch part installed on the both sides of the hollow part of fin box. Thus this member can prevent from creating unnecessary space and rattling. Therefore, this mechanism secures precise and tight attachment of a fin. Especially, the attachment of a fin without a screw would create a space, however, certain embodiments can efficiently prevent this issue.

The present invention can prevent the fin from rattling, which causes unexpected detachment and damage. In addition, the fin attachment without rattle or space can promote the efficiency of operation. Further, the fin attachment structure of this invention does not require screws. Instead it can be attained by inserting into hollow part of the base portion and by moving backward. Detachment can be attained in the reverse procedures.

From above reasons, certain embodiments can provide easy attachment/detachment and extremely user friendly structure. Next, another embodiment allows the installation of an arbitrary number of plungers in the opposing directions and thereby the adjustment of the force to sandwich and hold the fin by the plunger. Therefore, the fin attachment is enhanced for secure operation and prevention of rattling.

In addition, in another embodiment, the plunger can be used to attach the fin with its elastic force into the hollow part of the attachment base while the elastic material remains inside. Thus the fin can be securely fitted at the time of attachment/detachment which will prevent it from rattling and unexpectedly coming off. Next, in another embodiment, the structure may be one having at least two or more attachment bases on the side surface and more than two locations are the stopper bar between the fin and fin box, thus the construction can enforce the more secure attachment.

Furthermore, in another embodiment, the pin of the groove base is not the only attachment base, but can be mounted at different bases. Because of this reason, each pin can be mounted in a distance location wherein the pin is mounted corresponding to each groove base and fixed and stopped at the end portion. In a distance location, both side surfaces of the two spots can be stopped at the groove base and in this way, the attachment can be forced. Further, in another embodiment, a surfboard can be provided that has a structure of the groove bases for the fin attachment.

DETAILED DESCRIPTION

Figure 1:
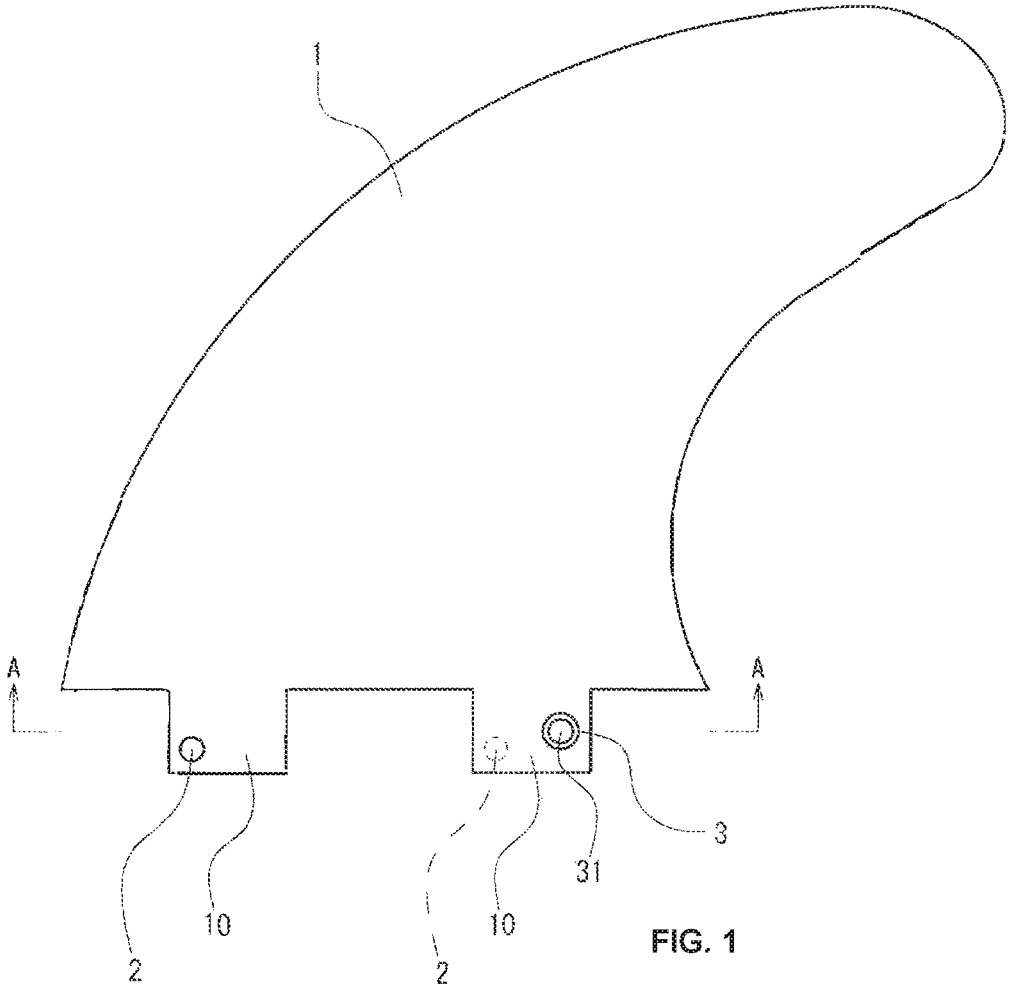
FIG. 1 is a diagram showing an example of a fin attachment part in a fin attachment structure.

FIG. 1 is a diagram showing a basic example of a fin attachment structure. As shown in this diagram, a fin box 1, which is comprising of the fin and the groove base 10, wherein holds two projection parts. Each projection portion holds the fin 2, which is projected in the traverse direction, each of which holds a pin 2 on the reverse side.

Further, plunger 3, situated with a projection part of ball part 31, is mounted on the side surface direction in the backward direction of the groove structure. That is this plunger 3 is mounted on the groove part 10 on the opposite direction of pin 2. Thus, the fin is fixed by inserting the groove part 10 of this fin attachment into fin box 4. At this time, the plunger 3 is installed under elastic compression force in the same direction of the pin 2 of the groove part 10 and the pin 2 is connected to the stopper bar of fin box 4.

In addition, plunger 3 is not mounted but only the pin 2 is mounted in the nose direction where the groove part 10 is located. Further, each pin 2 is mounted on the reverse side of each groove part 10. This configuration enables the fin box 4 to be connected to the stopper bar on the both side surfaces of the fin.

Figure 2:
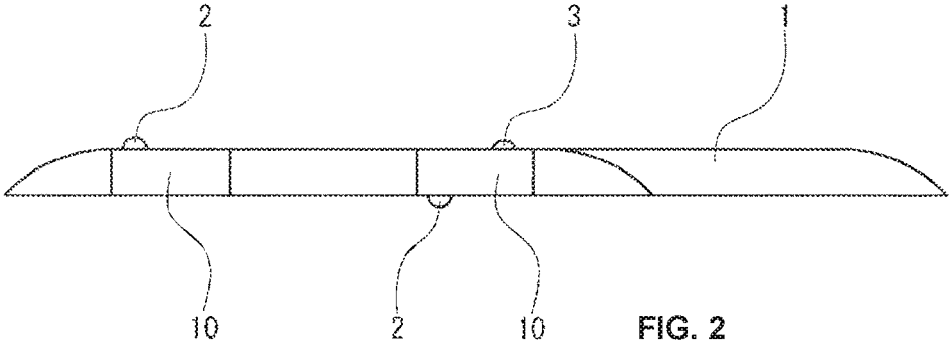
FIG. 2 is a diagram showing an example of a fin attachment part in a fin attachment structure.

FIG. 2 describes the mounting status of the pin 2 and plunger 3 on the groove base 10 of the fin. Pin 2 is mounted in one of the side directions of the groove base 10 which is located in the nose direction and in the opposite direction, pin 2 is mounted in the reverse side surface of the groove base 10. Further, plunger 3 is mounted in the reverse side surface of the opposite direction of the side surface of groove base 10, where the ball part 31 of the plunger 3 is mounted.

Figure 3:
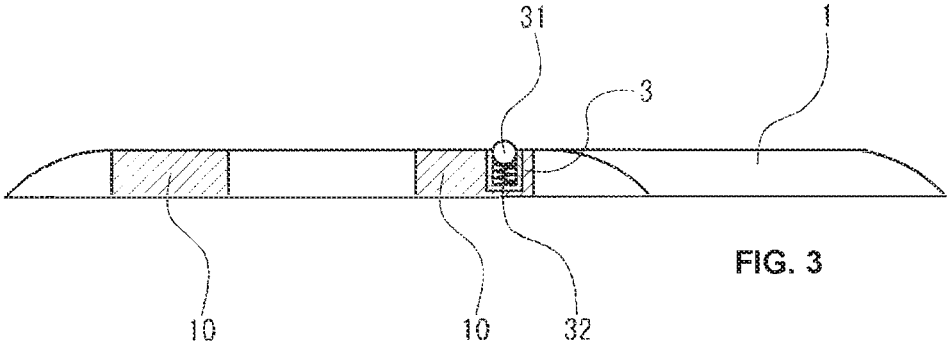
FIG. 3 is a cross-sectional view along A-A line in FIG. 1.

Pin 2 is mounted in the forward direction of each groove base 10 and plunger 3 is mounted in the backward direction of the groove base 10. However, two or more of pin 2 are mounted in a separated location of the forward direction and backward direction and each of them is mounted on the nose direction and bottom direction of the surfboard. In addition, FIG. 3. is a diagram showing the A-A cross-sectional dimension and the dimension of plunger 3.

Plunger 3 holds ball part 31 which is attached under elastic compression force with coil spring 32. Further, the structure of plunger 3 is one example, and it may be accepted when at least groove base 10 is attached securely to plunger 3 in one certain direction. In addition, the diagram describes one example of plunger 3, one of which is attached only to the groove base 10. However, two of them may be mounted to both surfaces of the groove base 10.

In such a case, other than mounting in the opposing direction, it may be acceptable to mount in the same direction. Further, the figure describes one example of the structure wherein the groove base 10 of the attachment has two projection parts. However, such structure may be accepted with one groove base 10 and pin 2 are mounted as projection portions shifting on both side surfaces of forward direction and the backward direction. Otherwise it is an acceptable structure which holds more than two, three or more, groove base portion 10 of the attachment. In this case, it is an acceptable structure which holds pin 2 shifting on both side surfaces of the forward direction and the backward direction.

That is, pin 2 may be mounted on any of groove base 10 of the attachment, and not necessarily limited to a specific groove base 10. In addition, two or more of pin 2 may be accepted and furthermore three or four of pin 2 may be accepted. Since there are two sets of pin 2 on both directions. the fin can be tightly fixed and sandwiched by both sides, this state allows the reduction of rattle on both right and left directions and enables tight attachment. This structure enables a tight fitting of the fin attachment and at the same time prevents the fin from inefficient operation caused by rattling.

Figure 4:
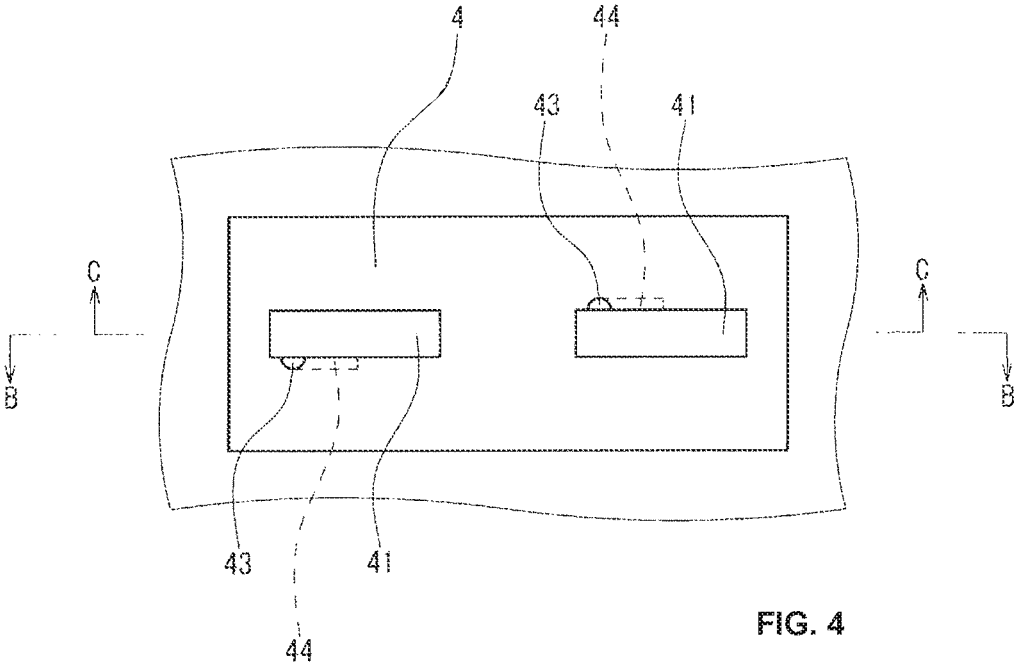
FIG. 4 is a diagram showing an example of fin box in a fin attachment structure.

FIG. 4 describes one example of the present invention of fin attachment structure to the fin box 4, especially, showing the fin which holds two of the groove base 10 of the attachment. Fin box 4 has the hollow part 41, which is longer than the groove base 10 of two of the fins in the lengthwise direction on both forward direction and backward direction. The structure is that the hollow part 41 has enough length in which the groove base 10 can be inserted and moved along the hollow part 41.

Further, the aforementioned hollow part 41 is as wide as or wider than the groove base 10 of the fin attachment, wherein both parts have almost same length. Consequently, when the groove base 10 is inserted into the hollow part 41, it can be tightly fitted in the widthwise direction and at least, tightly enough so as to allow moving in the forward direction and backward direction. Further, plunger 3 which is mounted. in the groove part 10 of the fin attachment is elastically compressed and attached into one direction preventing rattle and allowing tightly fitted under the inserted state.

In addition, the hollow part 41 is longer than the projection part of the groove base 10 of the fin attachment, deeper than the groove part 10. At least it has enough depth so that the groove part 10 can be mounted tightly and surely. Further, the hollow part 41 in the fin box 4, holds ditch 44, which is extended to the depth direction, is installed by connecting to the recess part 43 for pin insertion.

Due to the above mentioned configuration, ditch part 44 can hold a structure comprising of the projection part corresponding to pm 2 of the groove 10 of the fin attachment. When the groove part 10 of the fin attachment is inserted into the hollow part 41, ditch part 44 has structure of the recess part which corresponds to the projection portion of pin 2. Thus the insertion of the groove part 10 and locating the exact spot of the insertion becomes possible. This recess part 44 of the pin insertion has the recess along the bottom direction in the first part, however, later in the backward direction when it reaches a certain depth.

Thus, the structure of the recess part 43 mounted for the pin insertion, which corresponds to the pin 2 mounted on the groove base 10, enables the groove base 10 to fit into the hollow part 41. Further, the groove base 10 of the attachment is inserted to the bottom direction where ditch part 44 is mounted to move along to the nose direction of the surfboard and the reverse direction of the surfboard. This is the mechanism of how the ditch part 44 works along the fin movement.

Therefore, the mechanism of pin 2 enables the groove base 10 to move along the ditch part 44 to the nose direction of the surfboard in the backward direction and also in the opposite direction. Further, under an elastic compression force of plunger 3, the groove base 10, the fin can be attached and fixed, and its attached state can be maintained well.

Especially, the attachment by moving the fin to the backward direction causes the resistance of water from the nose direction of the operating surfboard, to the backward direction. At the time of the fin attachment, the fin receives elastic compression force from the forward direction from water when surfing. This means the fin is attached in the right direction. Therefore, it will not come off carelessly and the operation is secured safety.

In this case, the fin can be detached by pushing and moving it from backward direction to the forward direction along the recess part 43 by the pin 2 insertion to the ditch part 44. The fin is returned back to the starting position for the attachment, and thus can be easily detached. In addition, plunger-3 is mounted under an elastic compression force by pressing the fin in the backward direction, the ball part 31 is pressed into the coil spring 32 direction and the fin can be moved.

The aforementioned member makes the fin attachment/detachment extremely easy, and yet, the fin is fitted tight and does not come off, securing strongly tight attachment. The fin does not rattle in both sides of the right and left directions. The fin can be extremely secure with a tight fitting. This means that such configuration prevents the attached fin from rattling and dislocating on both side directions, and secures a tightly fixed attachment. This improves the effectiveness of the surfboard operation and at the same time prevents the fin from coming off and/or any damage.

Figure 5:
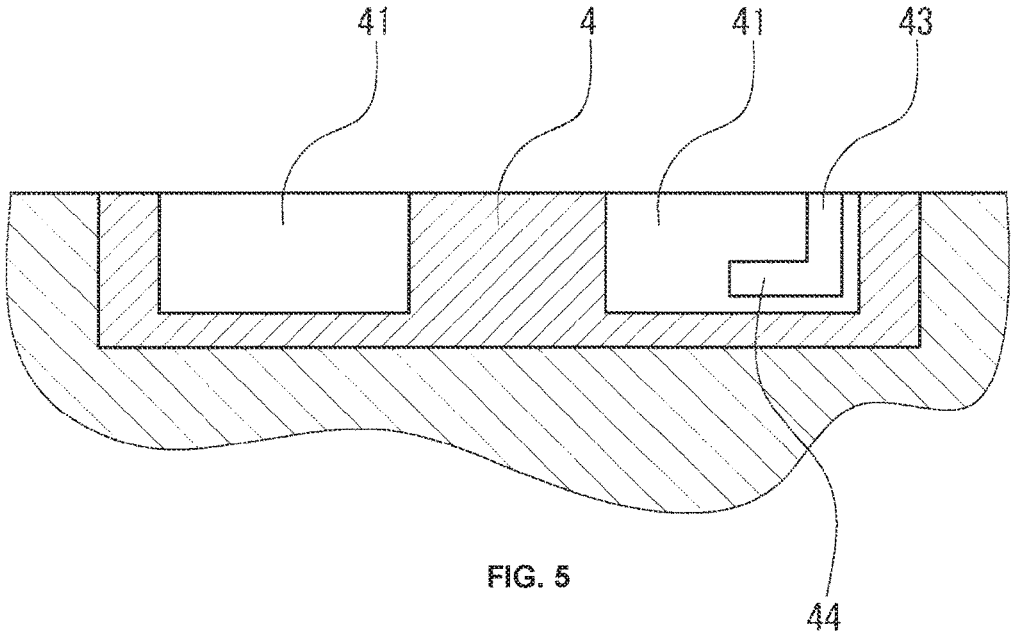
FIG. 5 is a cross-sectional view along B-B line in FIG. 4.
Figure 6:
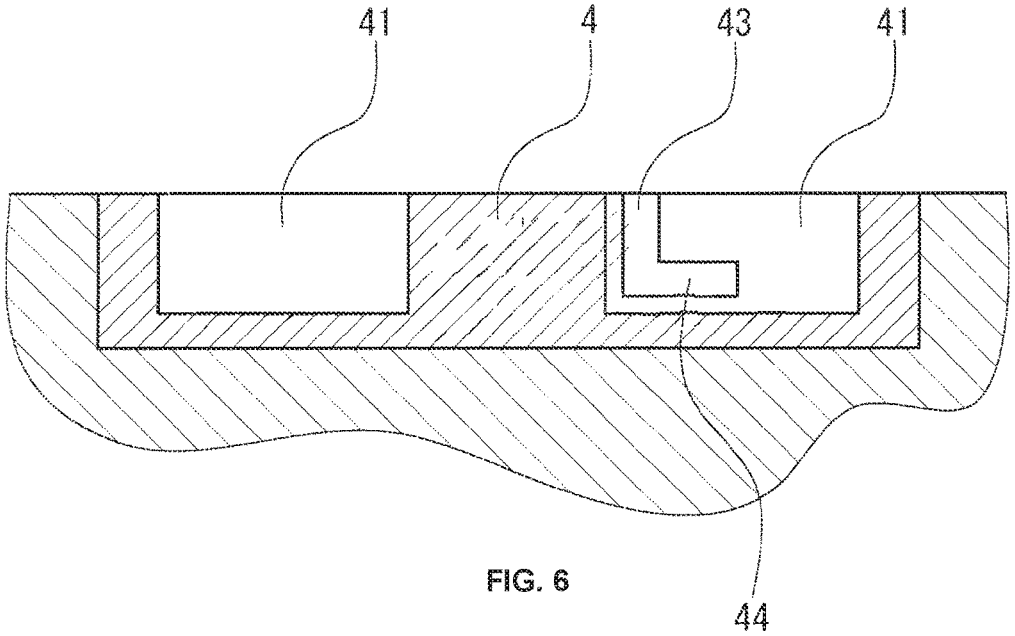
FIG. 6 is a cross-sectional view along C-C line in FIG. 4.

FIG. 5 and FIG. 6 describe the cross-sectional dimensions of the fin box. FIG. 6 shows the B-B cross sectional dimension of FIG. 4 and FIG. 6 shows the C-C cross-sectional dimension of FIG. 4. As shown in these Figures, the hollow part 41 holds the recess part 43 for the pin insertion and this ditch part 44 extends to the bottom direction, from the nose direction to the bottom direction which reaches to a certain depth and extends to the backward direction of the surfboard.

Figure 7:
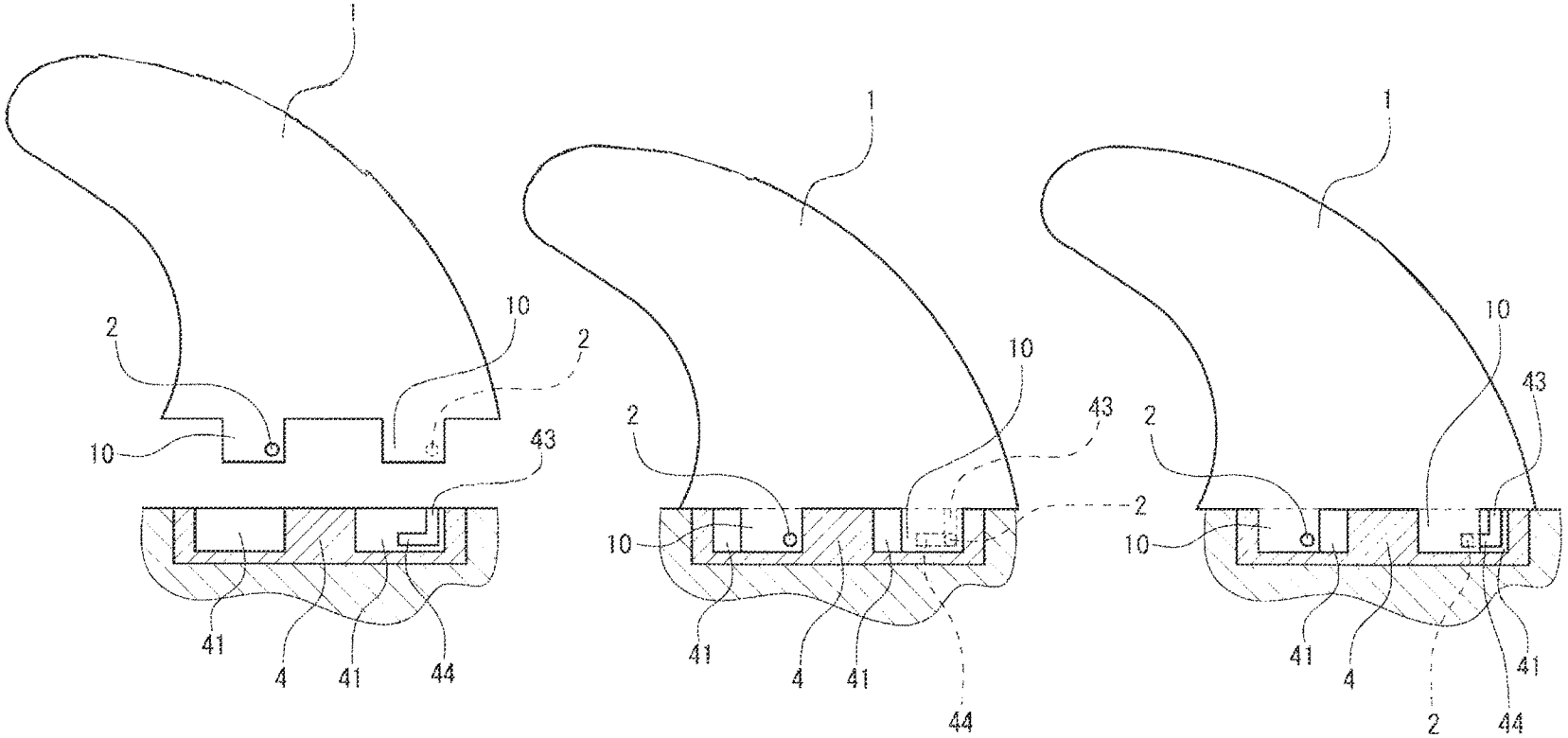
FIG. 7 is a diagram of showing an example of a fin state in a fin attachment structure.

FIG. 7 describes one example of the status of the attached fin. Each groove base 10 of the fin is to be inserted to the hollow part 41 of the fin box, Firstly, pin 2 of the groove part 10 is inserted to locate the corresponding recess part 43. Thus, at the time of the insertion, the corresponding part can be efficiently and accurately located. Therefore, by fixing the pin 2 in the location, the groove base 10 can be inserted to the hollow part 41 of the fin box 4.

Further, when the fin reaches the bottom, it is moved along the backward direction of the surfboard. At this state, the recess part 43 of the pin attachment and ditch part 44 are mounted on the side surfaces of the hollow part 41 of fin box 4, wherein ditch part 44 extends from the nose direction to the bottom direction. At the point of a certain depth, ditch 44 is mounted on the extension of the backward direction of the board, which is the opposite direction of the nose direction along the fin box to the horizontal direction of the surfboard.

Thus, the fin can move to the backward direction of the surfboard along the ditch part 44 which is fixed with this pin 2. Especially, the fin is constantly receiving resistant of water from the nose direction during surfing while the force comes toward the backward direction. However, since the fin is securely attached to that backward direction, the fin should never come off unexpectedly during surfing. In addition, such structure may be accepted that the ditch part continues to a certain point in the middle, which means the pin 2 moves to ditch part 44 and may stop near the end point.

Further, the figure describes the above procedure how the fin 1 is attached to the fin box, and with the reverse procedure, the fin can be simply detached. In addition, the figure describes the attached state, therefore, the plunger 3 is omitted. In addition, the figure describes two of each groove base 10 and the hollow part 41 in the fin box. However, three or more of each of the portions may be acceptable.

In such a case, the hollow part 41 of the fin box may hold the equivalent number of the groove part 10 of the attachment or may hold more than that which are to be attached the bases to the optional hollow part 41. Thus, the hollow part 41 may hold more number of the bases which are to be attached to the groove part 10.

Figure 8:
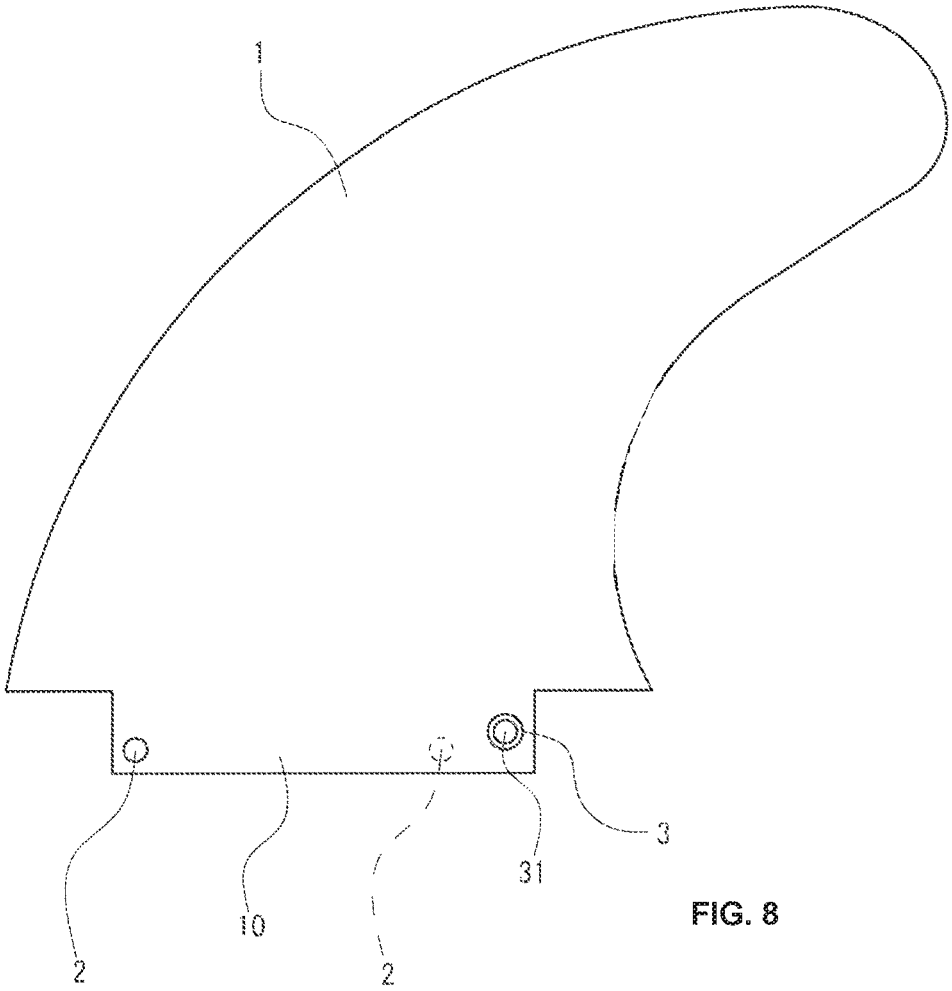
FIG. 8 is a diagram of another example of a fin attachment part in a fin attachment structure.

FIG. 8 describes one example of another structure of the fin attachment, showing especially the fin holds one of the groove base 10. As shown m this figure, the groove part 10 of the fin attachment holds pin 2, each on the both side surface, and at least each of the pin 2 on the side is mounted on the end direction of the opposing direction.

The aforementioned indicates that the pin 2 on both side surfaces are not mounted on both side surfaces of the same location. For example, when one of the pins is mounted on one of the end direction of the groove base 10, pin 2 of the reverse side is mounted in the distant direction of the forward direction and backward direction and for example, pin 2 is mounted on the other end direction of the groove base 10.

Such configuration enables the fin from both side directions to be sandwiched to the ditch 44. From both sides, the fin can be attached under elastic compression force and can prevent the fin from rattling. Further the configuration holds the plunger 3. Thus, the attachment can be elastically forced and completed.

Figure 9:
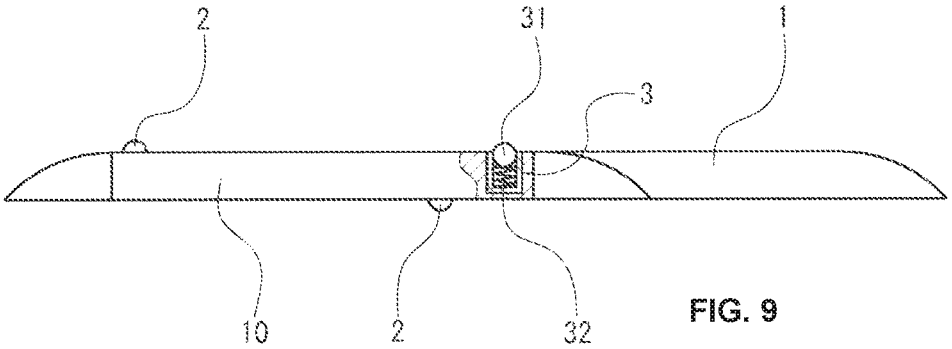
FIG. 9 is a cross-sectional view along the base part of a fin attachment structure.

FIG. 9 describes the cross dimension of the fin shown in FIG. 8, especially the cross dimension of plunger 3. As shown in this figure, pin 2 is mounted in both directions of the front and backward directions of fin 1. Further, the figure shows the plunger 3 which holds ball part 31 which is attached under elastic compression force by coil spring 32 on one side surface.

Figure 10:
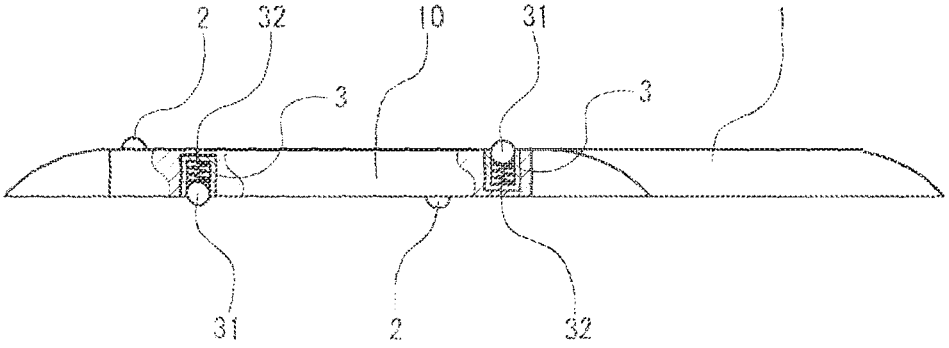
FIG. 10 is another cross-sectional view along the base part of an example of a fin attachment structure.

FIG. 10 describes one example of plunger 3 which is mounted on both sides. As shown in this figure, plunger 3 is mounted in the both side directions, and such a configuration may be accepted that in the ball part 31 of plunger 3, the groove part 10 is elastically forced to attach from the both side directions in the hollow part 41 of fin box 4.

Figure 11:
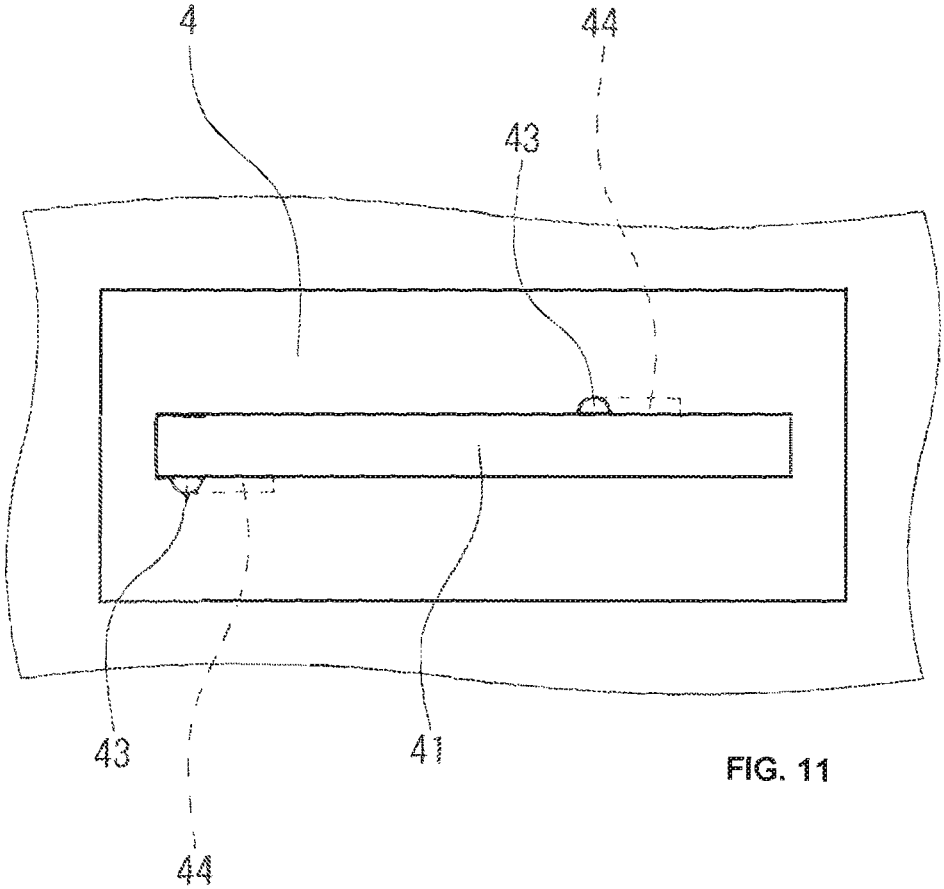
FIG. 11 is another example showing of a fin box which corresponds to a fin attachment structure described in FIG. 8.

FIG. 11 describes another example of fin box 4 for the fin attachment as shown in FIG. 8. The fin described in FIG. 8 shows the fin holding only one groove part 10 and describes one example of fin box 4 according to this configuration. Thus, fin box 4 holds recess part 43 for the pin insertion on both sides of fin box 4. The ditch part 44 after the recess part 43 continues to the bottom direction of fin box 4. And at the same time, the ditch part 44 is mounted on the location where the fin 1 of the groove part fits the pin 2, wherein the groove part 10 of the attachment can he fixed into the corresponding pin 2 when the fin inserted into the hollow part 41. The ditch part 44 is located from the nose direction to the bottom direction.

Further, this ditch 44 continues to the ditch in the backward direction along the lengthwise direction of the fin box 4 or to the backward direction of the surfboard. In such a case, the configuration may be acceptable that the ditch part 44 continues to a voluntary location.

Figure 12:
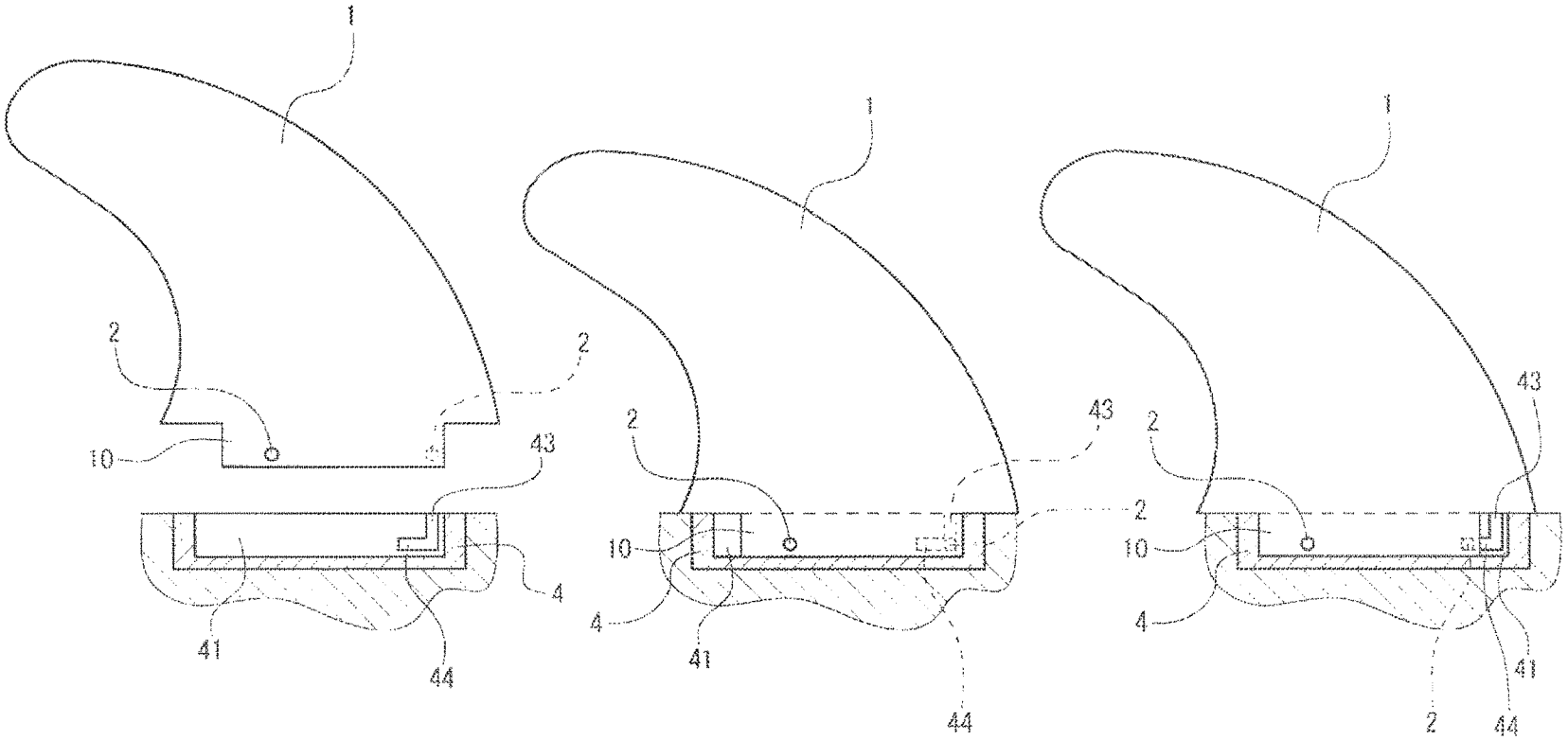
FIG. 12 is another example showing of the fin state which is attached to a groove structure of a fin attachment.

FIG. 12 describes one example of the fin 1. As shown, it is attached into the fin box 4 as shown in FIG. 8. As shown in the figure, the groove part 10 is inserted in the hollow part 41 of the fin box 4. Basically, the hollow part 41 of the fin box 4 is longer than the process portion of the groove part 10 of fin 1. In addition, the hollow part 41 of the fin box 4 is as wider as that of the groove part 10 or it may be acceptable to be a little wider.

Such configuration may be accepted that the depth to the bottom is deeper than the projection part of the groove part 10 of the fin 1 attachment. The groove part 10 of the fin 1 is inserted to the hollow part 41 of the fin box 4 as mentioned. The pin 2 of the groove part 10 is inserted by fixing into the recess part 43 of the hollow part 41 of the pin 2.

Further, after the groove base 10 of the fin is completely inserted, the fin 1 moves to the backward direction of the surfboard. In this case, the groove base 10 can be moved along the ditch part 44 following the recess part 43 for the pin inserting in the hollow part 41. For example, such a configuration may be acceptable if the pin 2 stops at the terminal of this ditch part 44 and the fin can be tightly attached.

Pin 2 is attached into the ditch part 44 and sandwiched from both sides holding the groove part 10 of the attachment from both sides and at the same time the plunger 3 is attached under elastic compression force. Thus, the fin can be surely attached eliminating the rattle and gap. In addition, this figure describes the status of the attachment and detachment of the fin and the plunger 3 is omitted in this drawing.

I claim:

1. A fin box for detachably attaching a fin to a surfboard, the surfboard having a nose and a tail at opposite ends, the fin comprising a groove base having one or more pins, the fin box comprising:

one or more inner walls having:

(i) a hollow base with a width that is at least as great as a width of the groove base and a length that is at least as great as a length of the groove base, (ii) one or more recess parts disposed at locations that correspond to the locations of the pins of the fin, the recess parts extending in a direction that is substantially perpendicular to a length of the fin box, and (iii) one or more ditch parts that extend from the recess parts, the ditch parts extending in a direction that is substantially parallel to the length of the fin box and toward the tail of the surfboard, wherein the recess parts and ditch parts are configured to allow the fin to be inserted into the fin box by (i) pressing the fin downward into the fin box until a bottom of the groove base is adjacent to the hollow base, and (ii) sliding the fin toward the tail of the surfboard, without any opposite motion toward the nose of the surfboard, and the ditch parts are configured to, when the fin is attached to the fin box, hold the pins of the fin in the fin box.

* * * * *